US007258066B2

(12) United States Patent
Koopmann

(10) Patent No.: US 7,258,066 B2
(45) Date of Patent: Aug. 21, 2007

(54) INKING SYSTEM FOR FLEXOGRAPHIC PRINTING PRESSES

(75) Inventor: Dietmar Koopmann, Lienen (DE)

(73) Assignee: Windmoeller and Hoelscher KG, Lengerich (DE)

( * ) Notice: Subject to any disclaimer, the term of this patent is extended or adjusted under 35 U.S.C. 154(b) by 57 days.

(21) Appl. No.: 10/504,859

(22) PCT Filed: May 12, 2003

(86) PCT No.: PCT/EP03/04952

§ 371 (c)(1),
(2), (4) Date: Aug. 30, 2004

(87) PCT Pub. No.: WO03/099567

PCT Pub. Date: Dec. 4, 2003

(65) Prior Publication Data

US 2005/0211117 A1 Sep. 29, 2005

(30) Foreign Application Priority Data

May 28, 2002 (DE) ..... 102 23 66

(51) Int. Cl.
*B41F 31/32* (2006.01)
*B41F 13/30* (2006.01)

(52) U.S. Cl. ..... 101/247; 101/216; 101/352.01

(58) Field of Classification Search ..... 101/182–185, 101/174, 216, 219–221, 247, 209, 218, 351.1–351.4, 101/352.01–352.05
See application file for complete search history.

(56) References Cited

U.S. PATENT DOCUMENTS 3,635,160 A * 1/1972 Specht et al. ..... 101/247
4,413,541 A * 11/1983 Biggar, III ..... 83/346
5,099,760 A * 3/1992 Schneider ..... 101/351.4
5,125,339 A 6/1992 Dieter
5,127,746 A * 7/1992 Rogge et al. ..... 384/436
5,341,739 A * 8/1994 Rogge et al. ..... 101/247
5,471,929 A * 12/1995 Rogge et al. ..... 101/247
5,617,789 A * 4/1997 Achelpohl et al. ..... 101/216
5,743,964 A * 4/1998 Pankake ..... 118/712
5,974,968 A * 11/1999 Achelpohl et al. ..... 101/247
6,220,162 B1 4/2001 Kolbe et al.
2006/0150843 A1* 7/2006 Rogge et al. ..... 101/350.6

FOREIGN PATENT DOCUMENTS

DE 100 24 350 11/2001
EP 0 438 716 7/1991
EP 0 955 161 11/1999
EP 0 990 520 4/2000

* cited by examiner

*Primary Examiner*—Leslie J. Evanisko
(74) *Attorney, Agent, or Firm*—Jacobson Holman PLLC

(57) ABSTRACT

An inking system of a flexographic printing press with an anilox roller and a printing plate roller involved in color transport is shown. The positions of these two rollers relative to each other and to the impression cylinder are set using positioning elements that include bearing blocks in which the axles of the two rollers are mounted and which are traversed by motors which turn respective spindles that engage through an inner thread mounted in or on the bearing blocks. The motors are mounted on the machine frame on sides of the two rollers turned toward or facing the impression cylinder.

15 Claims, 2 Drawing Sheets

INKING SYSTEM FOR FLEXOGRAPHIC PRINTING PRESSES

This is a nationalization of PCT/EP03/04952 filed May 12, 2003 and published in German.

BACKGROUND OF THE INVENTION

1. Field of the Invention

The present invention relates to the design of inking systems for flexographic printing presses. These inking systems are equipped with an anilox roller and a printing plate roller. These two rollers are involved in the color transport during the printing process. The two aforementioned rollers carry, as a rule, sleeves which must be replaced, in particular when changing jobs.

For this purpose, the inking systems are provided with setting devices with which the position, relative to the impression cylinder, of these two rollers involved in color transport can be set. In addition, the positions, relative to one another, of the two rollers involved in color transport can be set.

For this purpose, bearing blocks, in which the axles of the two rollers involved in color transport are mounted, are traversed. For this, each of the bearing blocks of a roller can be mounted on carriages which slide on suitable guides. There are inking systems in which the carriage of one roller slides on guides which are mounted on the carriage of the other roller. In the case of other inking systems, both rollers can be traversed completely independently of one another.

The force necessary for setting the position of the two rollers involved in color transport is prepared, as a rule, by spindles, which engage through an inner thread present in the bearing blocks, and which are turned by motors.

2. Description of the Related Art

Such a device is, for example, known from EP 0955161 A2. This publication shows an inking system in which the motors, which turn the spindles and apply the force necessary for position setting in the manner described above, are mounted on the machine frame on the side (turned away from the impression roller) of the two rollers involved in color transport.

Moreover, devices are known in which the motors which make possible the setting of the position of the printing plate roller are located on the inking system's side turned toward the impression cylinder while the motors which move the anilox roller are provided on the side of the rollers that is turned away from the impression cylinder.

The positioning of the motors on the impression cylinder's side turned away from the impression cylinder, however, causes a large structural length of the inking system.

SUMMARY OF THE INVENTION

The objective of the invention thus consists of proposing an inking system design which permits a reduction of the structural length of the inking system.

This objective is realized with the present invention by the fact that all the motors are mounted on the machine frame on the side of the two rollers involved in color transport turned toward or nearest the impression roller.

By machine frame, any machine components suitable for fastening are to be understood. The inking system's more compact mode of construction according to the present invention also leads to a reduction of the vibrations to which the rollers are subjected during the printing process. It is advantageous if the bearing block or blocks, which bear the axle of the anilox roller and the bearing block or blocks which bear the axle of the printing plate roller can be moved on different guides. In particular, guides set to different vertical positions from one another make possible a simpler positioning of the spindles in the inking system.

A particularly preferred development of the present invention is characterized by the positioning of the guides relative to the rollers such that the guides which bear the axle of one of the two rollers involved in color transport are disposed over these rollers, while the guides which bear the axle of the other roller involved in color transport are mounted under this roller.

In this way the motors and spindles which are assigned to the two rollers are spaced vertically in a simple manner so that their arrangement in the inking system causes no problems.

Additional embodiment examples of the invention follow from the description and the claims.

DETAILED DESCRIPTION OF THE PREFERRED EMBODIMENTS

Figure 1:
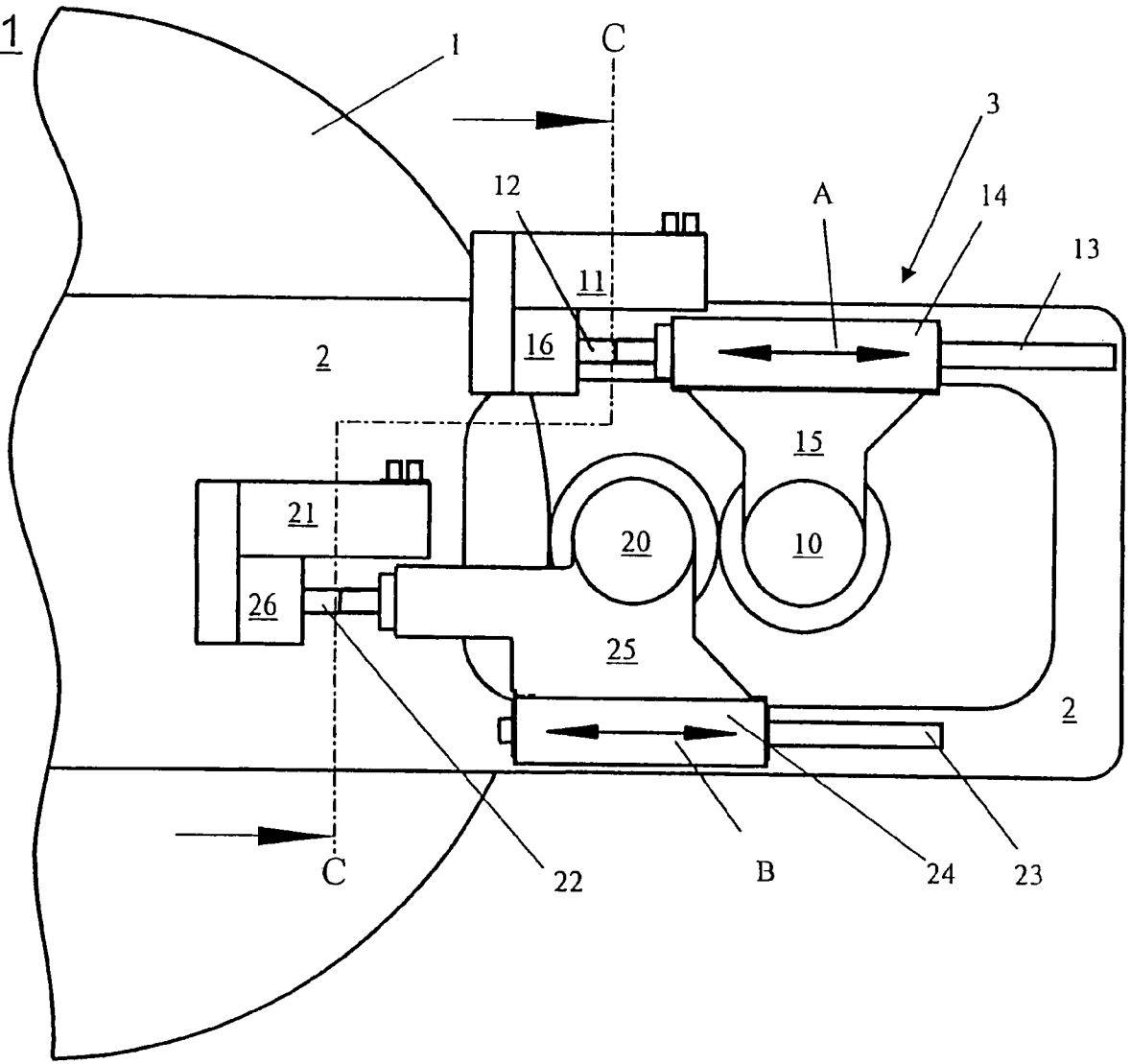
FIG. 1 shows a lateral view of an embodiment example of an inking system according to the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The figures show an embodiment example of an inking system 3 according to the present invention, in which inking system the positioning elements 21, 22, 23, 24, 25 assigned to the printing plate roller 20 are mounted below the printing plate roller 20 while the positioning elements 11, 12, 13, 14, 15 of the anilox roller 10 are disposed above the anilox roller 10. In this way the anilox roller 10, the axle-carrying bearing block 15, and the carriage 14 on which the bearing block 15 is mounted, are suspended on the guide bar 13. The force necessary for movement of the carriage in the direction indicated by the arrow A is provided by the motor 11 turning the spindles 12, which engage through an inner thread 17 provided in the bearing block 15.

Analogously to the design of the positioning elements 11, 12, 13, 14, and 15 for the anilox roller 10, the axle of the printing plate roller 20 is borne by the bearing block 25 which is mounted on the carriage 24. The carriage 24 slides in the direction predefined by the arrow B on the guide bar 23 if the spindle 22 is moved by the motor 21.

In the embodiment example represented, all the aforementioned positioning elements 11, 12, 13, 14, 15, 21, 22, 23, 24, 25 are carried by the machine frame 2. At the left edge of the picture of FIG. 1, the impression roller 1 is represented. In FIG. 1 the rollers are in the position set on the impression roller necessary for the printing process. FIG. 1 makes it clear that, when the positioning elements are in their respective positions above and below the rollers 10, 20 with the motors 11, 21 on the respective sides of the rollers 10, 20 turned toward the impression cylinder according to the present invention, the free path length of the two spindles 12, 22 between the respective bearing blocks 16, 26 of the spindles 12, 22 and the respective bearing blocks 15, 25, can be set to be minimal.

Figure 2:
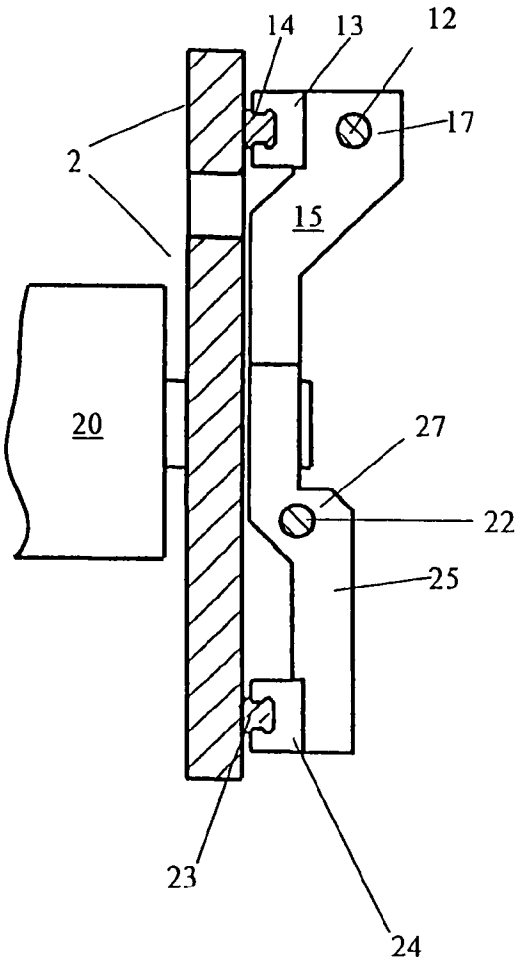
FIG. 2 shows a section through the inking system along the line C-C from FIG. 1.

FIG. 2 shows a section through the inking system 3 represented in FIG. 1 along the section line C-C. This section describes, in particular the function and position of the spindle 12 and guide bar 13. Also the inner thread 17 and 27 in which the spindles 12 and 22 are turned and which thus have the function of unrotatable nuts are to be seen in this representation.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

List of Reference Numbers

| | |
|---|---|
| 1 | Impression cylinder |
| 2 | Machine frame |
| 3 | Inking system |
| 4 | |
| 5 | |
| 10 | Anilox roller |
| 11 | Motor for the setting of the position of the anilox roller |
| 12 | Spindle for the setting of the position of the anilox roller |
| 13 | Guide for the setting of the position of the anilox roller |
| 14 | Carriage of the anilox roller |
| 15 | Bearing block for the anilox roller |
| 16 | Bearing block for the spindle 12 |
| 17 | Inner thread nut |
| 20 | Printing plate roller |
| 21 | Motor for the setting of the position of the printing plate roller |
| 22 | Spindle for the setting of the position of the printing plate roller |
| 23 | Guide for the setting of the position of the printing plate roller |
| 24 | Carriage of the printing plate roller |
| 25 | Bearing block for the printing plate roller |
| 26 | Bearing block for the spindle 22 |
| 27 | Inner thread nut |
| A | Arrow to indicate the how the anilox roller can be set |
| B | Arrow to indicate the how the printing plate roller can be set |
| C | View in FIG. 2 |

The invention claimed is:

1. An inking system of a flexographic printing press having an impression cylinder comprising:

an anilox roller and a printing plate roller for color transport;

a first set of positioning elements carried by a machine frame for setting a position of the anilox roller relative to the printing plate roller and relative to the impression cylinder, said first set of positioning elements including a first bearing block in which an axle of said anilox roller is mounted and a first motor, said anilox roller position being set by moving said first bearing block toward and/or away from said impression cylinder using said first motor;

a second set of positioning elements carried by said machine frame for setting a position of the printing plate roller relative to the anilox roller and relative to the impression cylinder, said second set of positioning elements including a second bearing block in which an axle of said printing plate roller is mounted and a second motor, said printing plate roller position being set by moving said second bearing block toward and/or away from said impression cylinder using said second motor;

said first and second motors being mounted on sides of said anilox and printing plate rollers, respectively, which are nearest the impression cylinder.

2. The inking system according to claim 1, wherein said first and second bearing blocks are slidably movable on two different guides, respectively.

3. The inking system according to claim 2, wherein said guides are set at different vertical positions.

4. The inking system according to claim 2, wherein one of the guides is mounted over said rollers, while the other of said guides is mounted under said rollers.

5. The inking system according to claim 1, wherein said first and second motors set the positions of the two rollers by spindles which engage through an inner thread mounted in or on the bearing blocks, respectively.

6. The inking system according to claim 1, wherein said first and second motors set the positions of the two rollers by two spindles which are threadedly engaged with the bearing blocks, respectively.

7. The inking system according to claim 6, wherein said bearing blocks slide on respective guides when moved by the motors through said threaded engagement with said spindles.

8. An inking system of a flexographic printing press having an impression cylinder comprising:

an anilox roller and a printing plate roller for color transport;

a first set of positioning elements for setting a position of the anilox roller relative to the printing plate roller and relative to the impression cylinder, said first set of positioning elements including a first motor, a first guide and a first bearing block in which an axle of said anilox roller is mounted, said anilox roller position being set by sliding said first bearing block along said first guide using said first motor;

a second set of positioning elements for setting a position of the printing plate roller relative to the anilox roller and relative to the impression cylinder, said second set of positioning elements including a second motor, a second guide and a second bearing block in which an axle of said printing plate roller is mounted, said printing plate roller position being set by sliding said second bearing block along said second guide using said second motor;

said first and second guides being set at different vertical positions.

9. The inking system according to claim 8, wherein one of the guides is mounted over said rollers, while the other of said guides is mounted under said rollers.

10. The inking system according to claim 8, wherein said first and second motors set the positions of the two rollers by spindles which engage through an inner thread mounted in or on the bearing blocks, respectively.

11. The inking system according to claim 8, wherein said first and second motors are mounted on sides of said anilox and printing plate rollers, respectively, which are turned toward or nearest the impression cylinder.

12. The inking system according to claim 8, wherein said first and second motors set the positions of the two rollers by two spindles which are threadedly engaged with the bearing blocks, respectively.

13. An inking system of a flexographic printing press having an impression cylinder comprising:

an anilox roller and a printing plate roller for color transport;

a first set of positioning elements for setting a position of the anilox roller relative to the printing plate roller and relative to the impression cylinder, said first set of positioning elements including a first guide, a first bearing block in which an axle of said anilox roller is mounted, a first spindle in threaded engagement with said first bearing block, and a first motor, said anilox roller position being set by turning said first spindle using said first motor to slide said first bearing block along said first guide;

a second set of positioning elements for setting a position of the printing plate roller relative to the anilox roller and relative to the impression cylinder, said second set of positioning elements including a second guide, a second bearing block in which an axle of said printing plate roller is mounted, a second spindle in threaded engagement with said second bearing block, and a second motor, said printing plate roller position being set by turning said second spindle using said second motor to slide said second bearing block along said second guide;

said first and second guides being set at different vertical positions.

14. The inking system according to claim 13, wherein one of the guides is mounted over said rollers, while the other of said guides is mounted under said rollers.

15. The inking system according to claim 13, wherein said first and second motors are mounted on sides of said anilox and printing plate rollers, respectively, which are nearest the impression cylinder.

* * * * *